United States Patent [19]

Turlej

[11] 4,205,306

[45] May 27, 1980

[54] BATTERY OPERATED SMOKE DETECTOR ELECTRONICS

[75] Inventor: Zbigniew W. Turlej, Toronto, Canada

[73] Assignee: Dicon Systems Limited, Toronto, Canada

[21] Appl. No.: 867,671

[22] Filed: Jan. 9, 1978

[51] Int. Cl.[2] ..... G08B 17/10

[52] U.S. Cl. ..... 340/629; 250/381; 331/113 R; 340/636

[58] Field of Search ..... 340/629, 636, 661, 662, 340/628, 630, 663, 664; 331/108 D, 111, 113 R; 250/381, 382, 384, 385, 389

[56] References Cited

U.S. PATENT DOCUMENTS

| | | | |
|---|---|---|---|
| 3,969,635 | 7/1976 | Wilke | 340/662 X |
| 4,020,479 | 4/1977 | Conforti et al. | 340/661 X |
| 4,083,037 | 4/1978 | Larsen | 340/636 X |
| 4,097,851 | 6/1978 | Klein | 340/628 |

FOREIGN PATENT DOCUMENTS

| | | | |
|---|---|---|---|
| 566602 | 9/1975 | Switzerland | 340/629 |

*Primary Examiner*—Sr. Caldwell
*Assistant Examiner*—Daniel Myer

[57] ABSTRACT

Improvements in battery operated smoke detector electronics including micro power astable multi-vibrator circuitry which has fast reliable switching of the inverters and electronic circuitry for single or dual ionization chamber smoke detector which maintains constant smoke detector sensitivity throughout the usable life of the battery.

7 Claims, 10 Drawing Figures

BATTERY OPERATED SMOKE DETECTOR ELECTRONICS

FIELD OF THE INVENTION

This invention relates to improvements in battery powered electronic smoke detectors.

BACKGROUND OF THE INVENTION

The use of battery powered smoke detectors is becoming widely accepted because they can be readily installed anywhere in a building by a person other than a qualified electrician.

Most smoke detectors comprise at least one ionization chamber having a radio-active source for ionizing molecules of air in the chamber and a pair of electrodes for establishing an electric field in the chamber region between them.

A problem associated with an ionization chamber connected to a battery is that the smoke detector sensitivity increases substantially and upwards of 30% upon an approximate 20% decrease in battery voltage. This substantial increase in sensitivity can result in the detector setting off an alarm for an insignificant concentration of smoke particles. This is annoying to the consumer and results in loss of confidence in the detector.

Further, there has been a problem in driving electronic multi-vibrator circuitry which activates an indicator means on a regular interval to indicate to the owner that the unit is receiving power. Most known multi-vibrators which are economically feasible for use in smoke detectors, draw far too much power from the battery so that they overlimit the battery life.

The improvements according to this invention provide a smoke detector which has constant sensitivity over the useable life of the battery and which has micropower astable multi-vibrator circuitry for activating a power "on" indicator on a regular interval.

In most smoke detectors of the type comprising at least one ionization chamber, an increase in voltage drop across the chamber is detected as caused by entry of combustion products. A predetermined concentration of combustion products corresponding to a least hazardous concentration results in an increment of voltage drop across the chamber for a fully charged battery. According to an aspect of the invention a first electronic means is provided to monitor the voltage drop across the ionization chamber. The first electronic means has a predetermined alarm threshold at which it causes an alarm signal corresponding to a voltage drop over the chamber for a fully charged battery at the predetermined concentration of combustion products. As mentioned, as the battery voltage decreases, the sensitivity of the detector increases. This is due to the increment in voltage drop increasing as the battery voltage decreases for the same concentration of combustion products. A second electronic means is provided to adjust upwardly the alarm threshold of the first electronic means as the battery voltage decreases. In so doing the first electronic means causes the alarm at approximately the same concentration of combustion products in the air throughout the useful life of the battery. This therefore achieves the desired constant sensitivity of the smoke detector.

In the instance where a pair of ionization chambers are employed, they are electrically connected in series. One of the chambers is open to atmosphere and the other is impervious to combustion products. The battery applies a voltage across the pair of chambers where a concentration of combustion products in the open chamber causes imbalanced voltage drops across the chambers. The first electronic means is adapted to monitor the voltage level between the pair of chambers. The alarm threshold of the first electronic means corresponds to a detected imbalanced voltage drop across the chambers caused by the predetermined concentration of combustion products. The pair of ionization chambers may be modified where the chamber which is impervious to smoke is replaced by a resistor means of a resistance equivalent to such chamber.

The micro-power multi-vibrator according to this invention draws very little current in providing a pulse on a prolonged interval, such as every 60 seconds, to activate a means to indicate a diagnostic function. For example, the signal may be used to activate a visual means to indicate that the unit is receiving power or activate an alarm on an intermittant basis to indicate that the unit is not functioning properly or that the battery is approaching the end of its useful life. The astable multi-vibrator circuitry comprises first and second inverters, each inverter including a pair of complimentary transistors. The output of the first inverter is coupled through the input of the second inverter. A capacitor couples the output of the second inverter to the input of the first inverter. A first resistor is coupled between the input and the output of the first inverter. A second resistor of substantially less resistance than the first is coupled with a diode in parallel with the first resistor. This provides an unbalanced charge time and discharge time for the compacitor so that the "off" time of the visual indicator is substantially greater than its "on" time. This multi-vibrator circuitry is improved upon by providing means for limiting current drawn during switching of states of the first and second inverters and means for maintaining a voltage on the inverters during their switching of states. The level of voltage provided is above a minimum voltage required to operate the inverters and is below the voltage applied to the inverters by the battery. Such means insures a reliable fast switching or inverter states. This results in very little current draw during multi-vibrator operation. Means is provided to derive a pulse output from the second inverter to activate the indication means.

According to another aspect of the invention in the multi-vibrator circuitry where field effect transistors are used the means for maintaining a voltage on the inverters may be adapted to decrease the voltage applied over the period of switching.

DESCRIPTION OF THE DRAWINGS

These advantages and features and others of the improvements of this invention will become apparent to those skilled in the art in the following detailed description of the preferred embodiments of the invention as shown in the drawings wherein.

DETAILED DESCRIPTION OF THE PREFERRED EMBODIMENTS OF THE INVENTION

Figure 1:
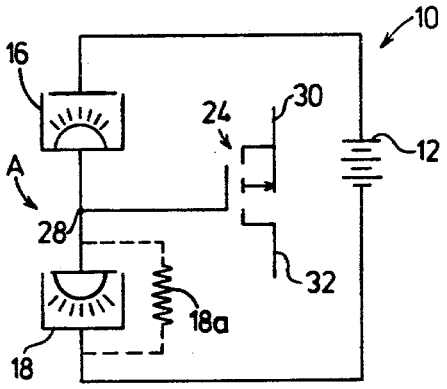
FIG.1. PRIOR ART
FIG. 1 is a schematic showing a prior art arrangement for an electronic smoke detector.

A general representation of a battery powered smoke detector is shown in FIG. 1. The detector 10 has a battery 12 which may be of the 9-volt battery size, for applying a potential across the dual ionization chamber arrangement 14. The dual ionization chambers comprise an open chamber 16 and a closed chamber 18. The closed chamber 18 is designed to be impervious to smoke, however, it is susceptible to slow changes in humidity and atmospheric pressure so that under normal conditions there is a balance in voltage drop across chambers 16 and 18. This arrangement is well known in the smoke detector field for overcoming false alarms. Each ionization chamber contains electrodes 20 and 22 where as shown they are connected in a manner to provide a series arrangement for dual chambers 16 and 18. In instances where only a single ionization chamber is desired, the above arrangement may be modified to eliminate chamber 18. It is appreciated that this may be accomplished in several ways, for example, substituting a resistor 18*a* as shown in dotted line for the chamber 18. The resistance of resistor 18*a* should be approximately the same as the resistance of the chamber 18 to provide essentially a balanced voltage drop.

A semi-conductor 24 has its gate or control electrode 26 connected to a point 28 between the dual ionization chambers 16 and 18. The semi-conductor 24 is in one state when the potential at point 28 is normal for balanced voltage drops across chambers 16 and 18. Upon an upset in balanced voltage drops across these chambers, such as caused by presence of combustion products entering chamber 16, results in changing the voltage level at point 28. The detector may be set so that a voltage level at 28 corresponding to imbalanced voltage drops caused by a predetermined concentration of combustion products in the air (corresponding to the beginning of a fire) is sufficient to switch states of the semiconductor 24. This change in state is detected at electrodes 30 and 32 to in turn actuate an alarm by way of amplifier circuitry not shown. The detector therefore has an alarm threshold corresponding to the predetermined concentration of combustion products.

Figure 2:
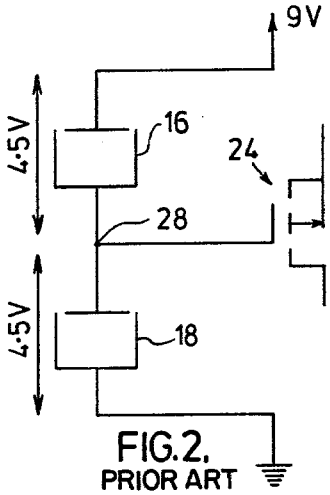
FIG.2. PRIOR ART
FIGS. 2 and 3 show schematically the change in voltage drops across the ionization chambers for decrease in battery voltage.
Figure 3:
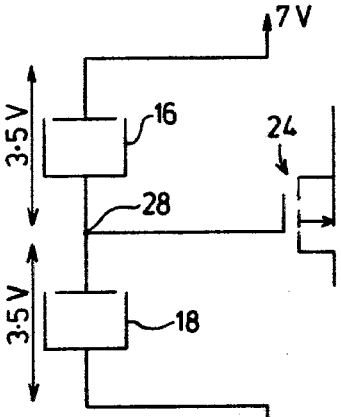
FIG.3. PRIOR ART

It is desirable in battery powered smoke detectors to have a battery which lasts for approximately one year. Such battery may be of the expandable type which is discarded or the rechargeable type which is recharged and reconnected to the detector. Looking at FIG. 2 for a new 9-volt battery with ionization chambers 16 and 18 in balanced condition, there is a balanced voltage drop of 4.5 volts across each chamber. As shown in FIG. 3 the lower useable voltage of the battery is arbitrarily set at 7 volts. For a balanced condition in ionization chambers 16 and 18 the voltage drop across the chambers then becomes 3.5 volts.

The equation which describes the current-voltage characteristic for an ionization chamber having a potential applied thereto in the range contemplated for smoke detectors, is as follows:

$$I = (qA\mu E/2\alpha)(\mu E/D + \beta N) \times \left\{ -1 + [1 + \frac{4\alpha Is}{qAD(\mu E/D + \beta N^2}]^{\frac{1}{2}} \right\} [A]$$

where $\mu$ is the ion mobility [$cm^2$/vsec], E the electric field [v/cm], $\alpha$ the volume recombination co-efficient [$cm^3$/sec], A the electrode area [$cm^2$], D the electrode separation [cm], $\beta$ the diffusion rate constant [$cm^3$/sec], N the smoke density [$cm^{-3}$], Is the saturation current [amps.], I the current [amps.] and q electronic charge [e]. From the above equation it can be calculated for certain chamber geometry that a decrease in voltage drop of one volt across each chamber corresponding to useable low portion of battery voltage decreases the current flow through the chamber by about 20 to 30 percent. The sensitivity of the detector can be based on the current change $\Delta I$ due to combustion products entering the chamber divided by the current I for no smoke present. The detector sensitivity for the battery at 9 volts corresponds to $\Delta I/I$, whereas the detector sensitivity for the battery at 7 volts is $\Delta I/0.8$ I due to a 20% decrease in current. The change in detector sensitivity is the absolute value of that at 9 volts minus that at 7 volts which is equal to $$\Delta I/I - \Delta I/0.81$$

i.e. 0.25 times $\Delta I/I$. At the end of the useable battery life of 7 volts, the sensitivity of smoke detector has increased by about 25%. This substantial increase in detector sensitivity will cause an alarm for less concentration of combustion products in the air than the detector was set for at fully charged battery condition. This problem may arise when someone is smoking beneath the fire detector and it goes off unwarrantly. This causes inconvenience to the consumer and raises doubts in their mind about the reliability of the detector.

Figure 4:
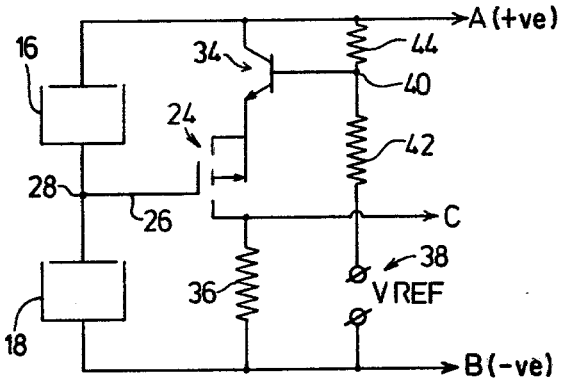
FIG.4. PRIOR ART
FIG. 4 is a schematic representative of circuitry which adjusts for decrease in battery voltage to maintain constant sensitivity.

To compensate for this increase in detector sensitivity, electronic circuitry as shown in FIG. 4 has been developed which as adapted for use with the device of FIG. 1, automatically increases the alarm threshold of the detector as the battery voltage decreases.

Figure 7:
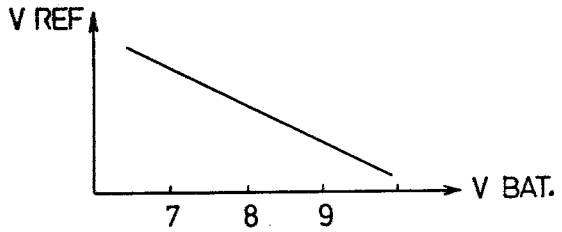
FIG. 7 is a plot of the desired characteristic of the reference voltage shown in FIG. 4.

In the embodiment shown in FIG. 4, the preferred semi-conductor 24 is a MOSFET, that is an insulated gate field effect transistor. It is appreciated that other forms of semi-conductors may be used, such as the more recent junction field effect transistor. The MOSFET 24 has its gate or control electrode 26 connected to a point 28, which is between the chambers 16 and 18. The source of the MOSFET is connected to the emitter of transistor 34 which has its collector connected to the positive terminal A of the battery. The drain of the MOSFET is connected in series with a current limiting resistor 36 to the negative terminal of the battery. A voltage reference is inserted in the circuitry and is generally designated as 38. The voltage reference has the characteristics as shown in FIG. 7 where its voltage increases as the battery voltage decreases.

In order to increase the detector alarm threshold as the battery voltage decreases with the embodiment shown, the voltage on the source of the MOSFET 24 must be moved upwardly at a rate which compensates for both the decrease in voltage at the source of MOSFET 24, change in voltage level at point 28 due to decreasing battery voltage and change in chamber current characteristics. The characteristics of the MOSFET 24 may be such that it switches states for a difference in source to gate voltage of one volt. As the battery voltage decreases, the difference in source to gate voltage becomes less and approaches 1 volt as compared to a difference which would be greater than 1 volt for a fully charged battery. The reference voltage 38 therefore serves to raise the source voltage of the MOSFET as the battery voltage decreases. The reference voltage 38 increases by an amount which maintains the difference in source to gate voltage at a level greater than the one volt threshold value to allow for increased sensitivity caused by change in chamber current characteristics resulting in an increase in the increment of voltage drop across the open chamber for the same concentration of combustion products. The unit is calibrated so that the reference voltage when the battery is at the end of its useable life, maintains a difference in source to gate voltage, such that the same concentration of combustion products in open chamber 16 is required to change the states of MOSFET 24 and thereby cause an alarm.

In order to transfer the reference voltage to the source of the MOSFET 24, a transistor 34 connected in the emitter-follower mode is used with its collector emitter path in series with the source-drain of MOSFET 24. Its base 40 is connected between resistors 42 and 44 which are connected in series between terminal A and reference voltage 38. Due to the characteristics of the emitter follower transistor, the voltage at the source of MOSFET 24 follows the increase in voltage at point 40.

In an embodiment of this invention MOSFET 24 may be a P-channel enhancement mode type where the MOSFET is normally on. Triggering the MOSFET results in turning it off. The alarm circuitry is therefore adapted to sense a relative zero potential between terminals B and C and upon positive detection causing an alarm.

A further point to be considered in designing the circuitry of FIG. 4 is that as the battery voltage across terminals A–B decreases, the potential at 28 is also decreasing. As mentioned for a decrease in battery voltage, the increment in voltage drop across chamber 16 has increased sufficiently to trigger MOSFET 24 prior to the level of predetermined concentration of combustion products in the open chamber. Therefore reference voltage 38 is designed to maintain the source of MOSFET 24 at a level so that the difference in gate to source voltage is greater than the difference when the battery is fully charged. This compensates for the sensitivity of the detector so that the MOSFET 24 switches states for approximately the same concentration of combustion products throughout the useful life of the battery.

Figure 5:
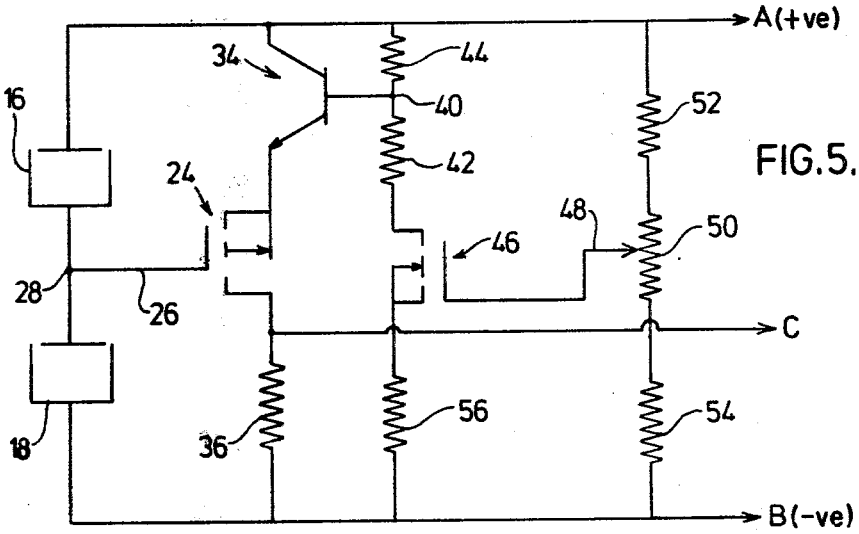
FIG. 5 is a schematic of an embodiment which provides the change in reference voltage shown in FIG. 4.

An aspect of the invention for the semi-conductor arrangement which varies the alarm threshold of the detector is shown in FIG. 5. The reference voltage 38 is now varied by way of a N-channel enhancement mode MOSFET 46. The MOSFET 46 functions so that as the potential on its gate electrode 48 decreases, the potential produced at point 40 is increased.

Figure 8:
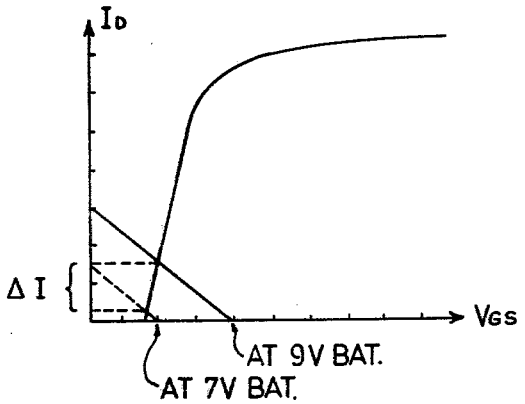
FIGS. 8 and 9 are plots showing the desired characteristics of a semi-conductor of FIG. 5 for use in varying the reference voltage.
Figure 9:
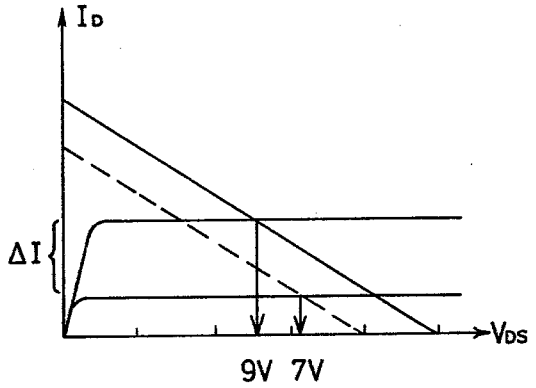

Turning to FIGS. 8 and 9 the properties of such N-channel enhancement mode MOSFET is shown in FIG. 8. A plot of drain current vs. the voltage (gate to source) is shown where for conditions of battery voltage at 7 volts and at 9 volts there is a difference in drain current. Turning to FIG. 9 this change in drain current when associated with the plot of drain current vs. voltage (drained to source) shows that for voltage (drain to source) at 9 volt battery voltage there is a lower voltage (drain to source) than when the battery voltage is at 7 volts.

Referring back to FIG. 5, the gate electrode 48 of MOSFET 46 is connected to a variable resistor 50 which is in series with resistors 52 and 54. A feedback resistor 56 is connected in series with the source of MOSFET 46. This resistor network acts as a voltage divider to provide by adjustable resistor 50 the proper voltage on gate electrode 48 for a fully charged battery at 9 volts. As the voltage at gate electrode 48 decreases due to a decrease in battery voltage across points A and B, the N-channel enhancement mode MOSFET 46 increases the voltage (drain to source) to thereby increase the voltage at point 40. Resistors 42 and 44 act as a voltage divider to provide the correct potential at point 40 for transistor 34 in the emitter-follower mode.

It is understood that depending upon the ionization chamber configuration, the properties of the various semi-conductors and resistors in the circuitry shown in FIG. 5 will vary. One skilled in the art can readily select the proper values for and types of the electronic components in order to use the underlying principles of this invention in maintaining constant detector sensitivity during useable battery life.

Figure 6:
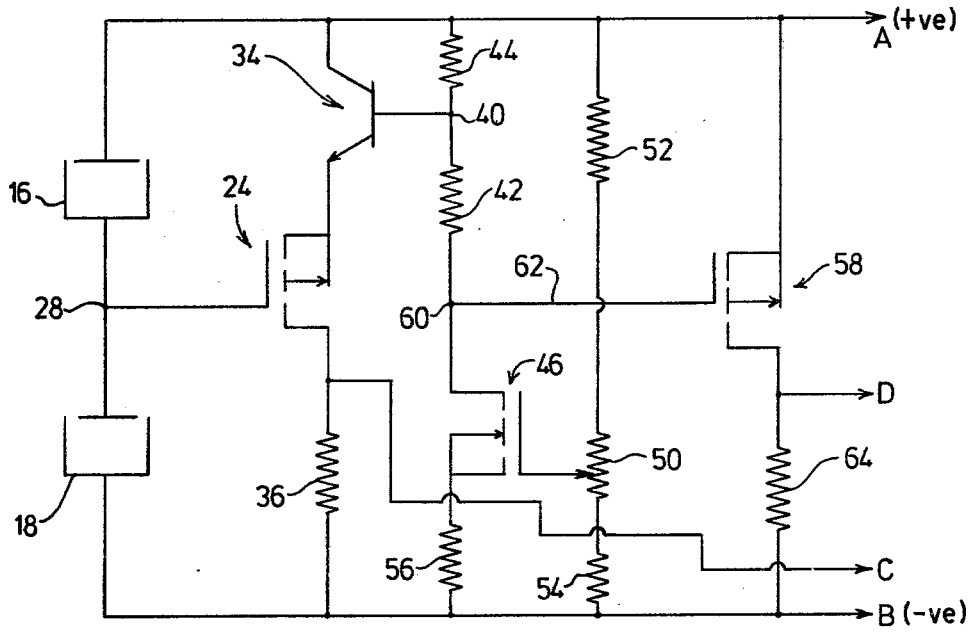
FIG. 6 is a schematic showing circuitry of a preferred embodiment which includes the feature of FIG. 4 and a low battery sensing circuitry.

FIG. 6 illustrates an embodiment of the invention where electronic means is provided to sense the battery voltage and provide a signal to actuate a visual or audible indication that the battery voltage has dropped below its useable potential. In this embodiment a P-channel enhancement mode MOSFET 58 has its control gate connected at 60 to the drain side of MOSFET 46. As the potential at 60 increases corresponding to a decrease in battery voltage, the potential on control gate electrode 62 thereby increases. Due to the properties of MOSFET 58 a corresponding decrease in voltage of drain to source takes place. Electronic circuitry is connected to points B and D to monitor the voltage drop across resistor 64. The parameters of the circuitry are such that when the voltage at control gate 62 reaches a level corresponding to a battery voltage of approximately 7 volts, the MOSFET 58 is turned off. This results in substantially zero voltage drop across resistor 64. This is sensed across points B–D to actuate a visual or audible low battery signal by appropriate electronic circuitry.

The principles of the invention as exemplified by the component layout described in the drawings can be formed into an integrated circuit. As an example in making the integrated circuit, a comparator may be used for sensing the voltage level at point 28 and causing an alarm for a voltage level corresponding to the predetermined concentration of combustion products in the air. The reference voltage input for the comparator may be changed to adjust the detector alarm threshold in compensating for the increase in increment of voltage drop across the open chamber for the same concentration of combustion product which is caused by a decrease in battery voltage. The reference voltage input could be changed automatically in a manner and to a level corresponding to the change in battery potential so that the comparator changes states to provide an output which causes an alarm at the same predetermined concentration of combustion products throughout the useable life of the battery.

The circuitry according to this invention is of economical construction for detecting unwarranted concentration of combustible products in the air. The parameters of the circuit may be selected so that there is very low current draw on the battery connected across terminals A–B.

Figure 10:
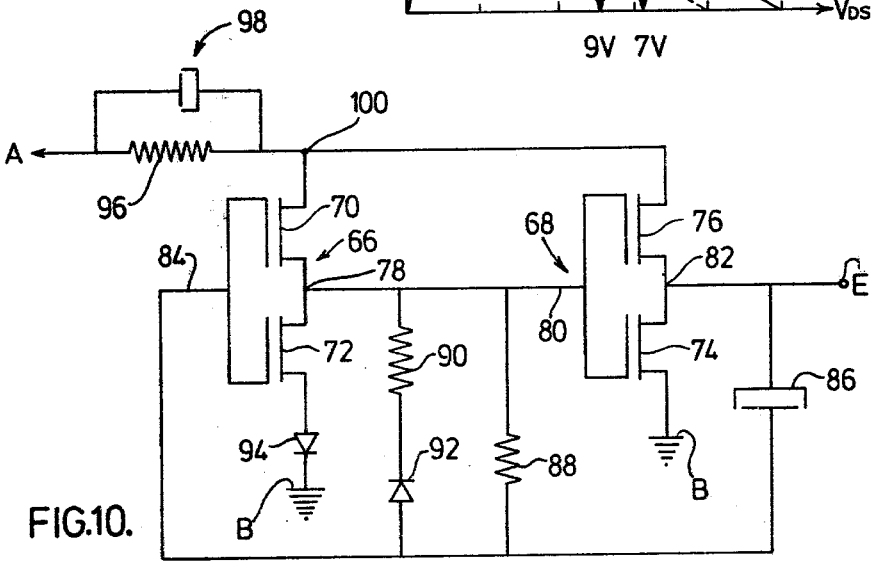
FIG. 10 is a schematic showing micro-power astable multi-vibrator circuitry having low current draw.

According to another aspect of the invention a preferred embodiment for the astable multi-vibrator circuitry is shown in FIG. 10. This unit has a very low current draw in providing a pulse on a regular basis to indicate visually to the consumer that the smoke detector is receiving power or may be used to activate an alarm on an intermittent basis in response to the detection of a low battery condition. The multi-vibrator may be used in combination with the smoke detector unit of FIG. 4.

The potential of the battery is applied across points A–B of the multi-vibrator circuit. The output of the circuit is obtained from terminal E. The multi-vibrator circuit comprises two inverters generally designated at 66 and 68. Each inverter comprises complimentary symmetry N-channel and P-channel MOSFETS. For purposes of discussion, when a channel is referred to as being "open", it is conducting and when a channel is referred to as being "closed" it is not conducting.

The P-channel MOSFET in inverter 66 is designated 70 and operates in the enhancement mode. The N-channel MOSFET in inverter 66 is designated 72 and operates in the enhancement mode. Not shown are the substrate gate connections for the MOSFETS. Similarly, with inverter 68 the P-channel MOSFET 74 operates in the enhancement mode and the N-channel MOSFET 76 operates in the enhancement mode. The output 78 of inverter 66 is connected to the input 80 of inverter 68. The output 82 of inverter 68 is connected to the input 84 of inverter 66 through capacitor 86. Resistor 88 is connected between output 78 of inverter 66 and capacitor 86. In parallel with resistor 88 is a second resistor 90 in series with a diode 92 which is also in series with capacitor 86 and output 78 of inverter 66.

At the ground side of inverter 66 is a diode 94, the purposes of which is to ensure that the threshold of the inverter 66 is slightly above that of inverter 68. As can be appreciated by those skilled in the art, the thresholds of the inverters cannot be readily manufactured in a commercially feasible manner to be identical. This can result in the threshold of inverter 68 being slightly above that of inverter 66. This would cause improper functioning of the multi-vibrator. The diode 94 is therefore placed at the ground side of inverter 66 so that the voltage drop over the diode will be sufficient to place the switching point of inverter 66 before that of inverter 68.

A feature of this multi-vibrator circuitry is that means is provided to limit the current drawn by the inverters during their switching of states. As can be appreciated during the time that each inverter switches states channels 70 and 72 are partially open providing a conduction path to ground. The means for limiting the current drawn prevents excessive battery discharge during the switching of states. By including the means for limiting current, this causes the voltage on the inverters to fall to an unacceptable level during the switching of states which places the unit in a non-oscillating mode. Means is therefore provided to maintain a voltage on the inverters which is above the minimum voltage required to operate the inverters and which is below the voltage applied to the inverters in one of their states by the battery.

In the preferred embodiment shown, the means for limiting high current drain when both channels of the inverters are opened directly to ground is resistor 96. The means for maintaining the voltage on the inverters during the switching of states, is capacitor 98 which is arranged in combination with resistor 96, to maintain the voltage at point 100 within the limits defined above. Although capacitor 98 is shown as being connected in parallel with resistor 96, it may also be connected in series with resistor 96 via point 100 to ground. Various devices may be substituted for resistor 96 and capacitor 98 as will be understood by those skilled in the art, particularly with respect to circuit integration of what is shown in FIG. 10.

The operation of the multi-vibrator circuitry is as follows. With capacitor 86 in a no charge condition and a potential applied across points A–B, the output at E is zero. MOSFETS 70 and 74 provide a path for charging capacitor 86 through resistor 88. Diode 92 precludes capacitor 86 charging through 90 when MOSFET channels 70 and 74 are open. As the charge on capacitor 86 reaches the threshold voltage on gate 84, the MOSFETS 70–72 begin switching states. For example, the threshold of inverter 66 may be one-half the voltage at point 100. If the voltage at 100 is 8 volts, then threshold voltage is 4. For an instant channels of MOSFET 72 and 70 are open to provide a direct line to the ground for battery at A. However, as mentioned, resistor 96 acts as a current limiting device to prevent high current drain on the battery.

Capacitor 98 maintains the voltage up on the CMOS inverter during the switching of states. Prior to the switching of states capacitor 98 will have charged to the difference between the potential at point 100 and the battery voltage. As the inverter 66 begins switching states, channels 70 and 72 are partially opened and act as a resistance to the charging of capacitor 98 through to ground. Since capacitor 98 cannot charge immediately, the potential at 100 falls off slowly from a potential of approximately 8 volts. With the potential at 84 of 4 volts in this example, then with the falling of the potential at 100 the inverter 66 speeds up its switching because the difference in potential at 84 and 100 is getting smaller and has not approached a negative value. After inverter 66 and 68 have switched their states, capacitor 98 begins discharging through resistor 96 until the inverters switch states again.

After the switching of states of inverter 66 is completed in this example, the input to inverter 68 is then essentially at ground through open channel 72, so that inverter 68 has switched to open channel 76 and close channel 74. The output at E is therefore a portion of the voltage at 100. Due to resistor 90, the capacitor 86 does not discharge immediately, the potential at 84 therefore becomes the threshold voltage plus the voltage at point 100 because the channel of MOSFET 76 is "open". Capacitor 86 discharges through diode 92, resistor 90 and diode 94 because the value of resistor 90 is far below the value of resistor 88.

The voltage on capacitor 86 continues discharging until the voltage at 84 drops through the threshold voltage of inverter 66 to begin the switching of states. The diode 94, ensures that threshold of inverter 66 is above that of 68 so that the switching of states begins first in inverter 66, as the voltage on capacitor 86 falls through the threshold voltage. The channel of MOSFET 70 opens and the channel of MOSFET 72 closes to provide a high signal input at 80 to inverter 68 to cause it to switch states where the channel of MOSFET 76 closes and the channel of MOSFET 74 opens. The sequence of the multi-vibrator is repeated as long as there is proper potential.

The values of the components in the circuitry can be selected so that the average current drawn by the multi-vibrator is approximately 3 micro-amps to give a pulse of approximately 2 or 3 volts for 50 milliseconds every 60 seconds. Examples for values of the components may be as follows:

(i) the voltage at A for a fully charged battery is 9 volts, (ii) Resistor 96 may have a value of 1 M Ω

(iii) Resistor 90 may have a value of 22 K Ω

(iv) Resistor 88 may have a value of 20 M Ω

(v) The capacitor 86 may have a value of 2.2 μF.

With these values it can be seen that it takes substantially longer to charge capacitor 86 through resistor 88 than to discharge it through resistor 90 to give a very short pulse over a relatively large interval.

This multi-vibrator circuitry substantially conserves on power consumption to provide a pulse for activating electronic circuitry to turn on a visual indicator to confirm to the consumer that the unit is receiving power. Due to its very low current draw, and its incorporation with a battery powered smoke detector, the useable battery life may be approximately 1 year.

Although various aspects of the invention have been described in detail, it will be understood by those skilled in the art that variations may be made thereto without departing from the spirit of the invention or the scope of the appended claims.

The embodiments of the invention in which an exclusive property or privilege is claimed are defined as follows:

1. An electronic smoke detector for setting off an alarm on detecting a predetermined concentration of combustion products in the air, said detector having constant sensitivity throughout useable battery life, said detector comprising an ionization chamber having a radioactive source for ionizing molecules of air in such chamber and a pair of electrodes in such chamber for establishing an electric field in the chamber region between them, a battery for applying voltage across such chamber by way of said electrodes where presense of the predetermined concentration of combustion products in such chamber causes an increment in the voltage drop across such chamber, the increment in voltage drop increasing as the battery voltage decreases for the same concentration of combustion products in the air, a first electronic means adapted to monitor the voltage drop across such chamber, said first electronic means having a predetermined alarm threshold corresponding to the increment in voltage drop for a fully charged battery at which it causes an alarm signal for said predetermined concentration of combustion products, a second electronic means adapted to detect decrease in said battery voltage and adapted to adjust upwardly said alarm threshold on detecting decrease in said battery voltage to compensate for said increase in voltage drop increment so that said first electronic means causes such alarm signal at approximately the same predetermined concentration of combustion products in the air throughout useable battery life.

2. An electronic smoke detector of claim 1 wherein a pair of ionization chambers are electrically connected in series, one of said chambers being open to atmosphere and the other being impervious to combustion products, said battery applying a voltage across said pair of chambers where a concentration of combustion products in said open chamber causes imbalanced voltage drops across the chambers, said first electronic means being adapted to monitor the voltage level between said pair of chambers, said alarm threshold of said first electronic means corresponding to detected imbalanced voltage drops across said chambers caused by said predetermined concentration of combustion products.

3. An electronic smoke detector of claim 2 wherein said first electronic means comprises a first semi-conductor having its gate electrode connected between said chambers and its major path of conduction connected in parallel with said battery, the alarm threshold of said first semi-conductor is such for a fully charged battery that a change in gate voltage caused by said predetermined concentration of combustion products in said chamber changes states of said first semi-conductor thereby to cause an alarm signal, said second electronic means comprises a second semi-conductor connected across said battery and having its gate electrode connected to a resistor means which is connected in parallel with said battery, the conductivity of said second semi-conductor increasing as the voltage on its gate decreases due to detected battery voltage decrease, said second semi-conductor being so arranged electronically relative to said first semi-conductor that it increases the alarm threshold of said first semiconductor.

4. An electronic smoke detector of claim 3 wherein each of said first and second semi-conductors is a field effect transistor.

5. An electronic smoke detector of claim 4 wherein a transistor in the emitter-follower mode is placed in series with said first field-effect transistor, the base electrode of the emitter-follower transistor being connected to the source-drain of said second field-effect transistor.

6. An electronic smoke detector of claim 3 wherein a third semi-conductor has its gate electrode connected to the path of conduction of said second semi-conductor, as the battery voltage decreases, the voltage on said gate of said third semi-conductor increases to eventually change states of the third semi-conductor and activate a means for indicating that the battery voltage has decreased to its lower useable limit.

7. An electronic smoke detector of claim 1 wherein sensor means is provided to sense the decrease in voltage of said battery and is adapted to cause an indication of low battery voltage when the battery voltage has decreased to its lower useable limit.

* * * * *